United States Patent [19]

Lueschen

[11] 4,250,904

[45] Feb. 17, 1981

[54] COIN DISPENSER ATTACHMENT

[75] Inventor: William K. Lueschen, Pewaukee, Wis.

[73] Assignee: Brandt, Inc., Watertown, Wis.

[21] Appl. No.: 71,061

[22] Filed: Aug. 30, 1979

[51] Int. Cl.[3] ..... G07D 1/06

[52] U.S. Cl. ..... 133/2

[58] Field of Search ..... 133/2, 5 A, 5 B, 6, 133/4, 4 A, 1 R, 1 A; 221/274, 276

[56] References Cited

U.S. PATENT DOCUMENTS

| | | | |
|---|---|---|---|
| 1,607,796 | 11/1926 | Mellor | 133/5 B |
| 2,857,920 | 10/1958 | Buchholz et al. | 133/4 |
| 2,888,124 | 5/1959 | Buchholz et al. | 193/31 |
| 2,922,427 | 1/1960 | Buchholz et al. | 133/2 |
| 3,590,833 | 7/1971 | Walton | 133/4 A |

*Primary Examiner*—Stanley H. Tollberg
*Attorney, Agent, or Firm*—Quarles & Brady

[57] ABSTRACT

There is disclosed a kit which can be attached to a coin dispensing machine to permit manual dispensing of an additional denomination. The kit includes an upper storage and ejector assembly which is attached to a side of the coin dispenser and which receives a stack of coins. The upper assembly has a manual ejector mechanism for removing coins one at a time from the bottom of the stack. The removed coins fall through an opening into a funnel which is mounted on top of the external coin discharge chute of the dispensing machine. In the funnel coins are placed in an upright position and roll down inclined floors until they fall into the open top of the discharge chute.

6 Claims, 7 Drawing Figures

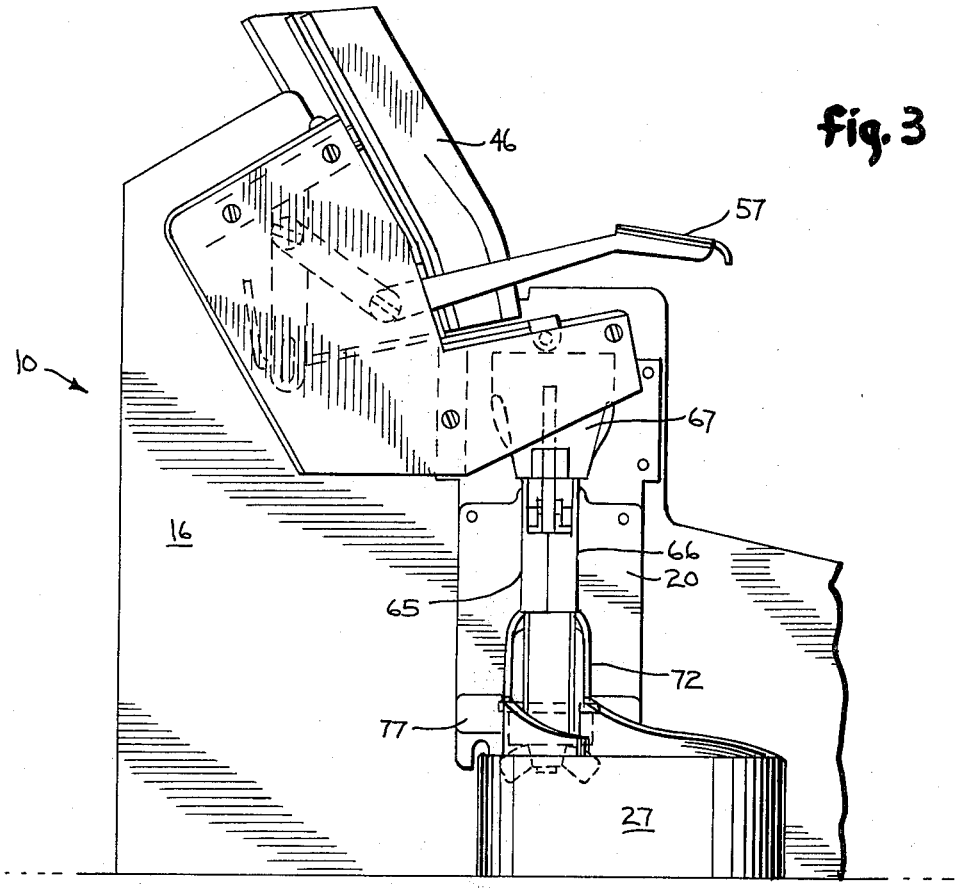
fig. 3
fig. 6
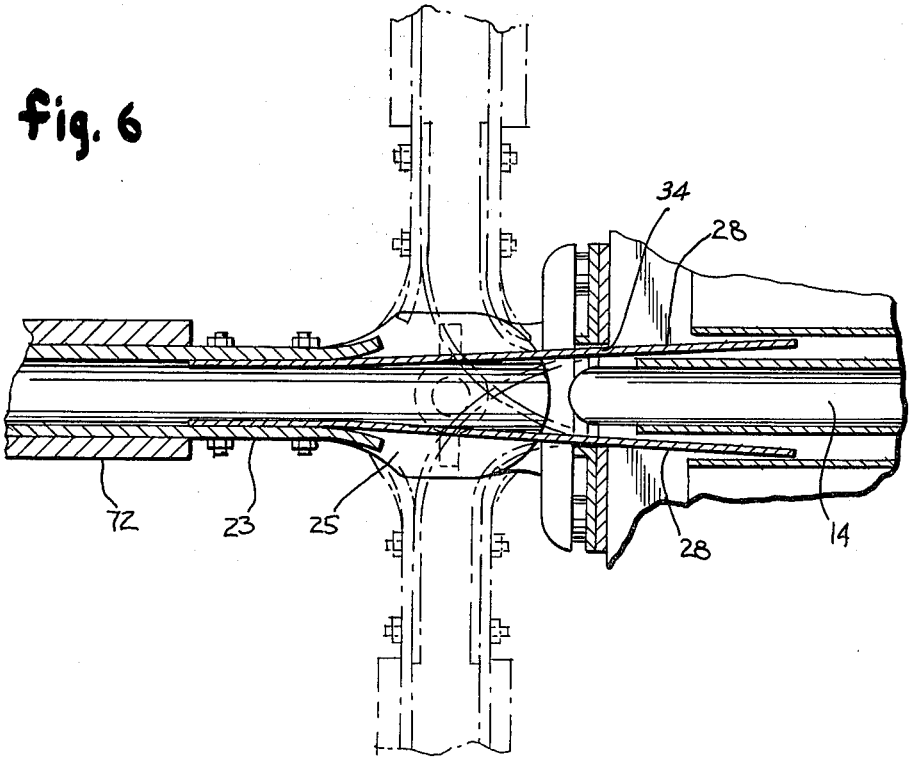

COIN DISPENSER ATTACHMENT

BACKGROUND OF THE INVENTION

This invention relates to coin dispenser equipment, and more particularly to an apparatus which can be mounted on a coin dispenser to provide for the manual dispensing of an additional denomination of coin.

Coin dispensing equipment is commonly employed at point of purchase locations, either in connection with a cash register or as a stand-alone unit, to provide the automatic dispensing of change to a customer. The coin dispensers typically employ a generally upright tray or magazine provided with side-by-side compartments which hold stacks of coins of different denominations. Upon command, the coin dispenser will typically dispense coins by removing one or more coins from the bottom of a stack in the magazine. The coins are ejected onto an inclined chute and roll out to one side of the coin dispenser. From that point a chute extension will typically direct the coin to a cup from which the customer can retrieve the coins. Originally, the mechanism for commanding the discharge of particular coins and the force to accomplish the ejection of coins was supplied by an operator depressing keys on a keyboard. At the present, the keys actuate switches which control solenoids that dispense the coins.

There are numerous patents disclosing coin dispenser mechanisms and control apparatus. Examples include U.S. Pat. No. 2,857,920, issued Oct. 28, 1958 to Buchholz et al, and U.S. Pat. No. 2,922,427, issued Jan. 26, 1960 to Buchholz et al.

Although the coin trays or magazines are often removable, the coin compartments in the coin trays are each sized to accept only a particular denomination of coin. Furthermore, the mechanism which ejects the coins from a particular stack is sized to accommodate that specific denomination of coin. Therefore, the usual coin dispenser is incapable of accepting coins of denominations for which it was not originally designed without undergoing an extensive reworking. Nevertheless, there are occasions when it is necessary to accommodate an additional or a different denomination of coin than that for which the coin dispensers have been designed. An example of circumstances which can require such action is the newly introduced Susan B. Anthony dollar coin of the United States coinage system.

The coin dispenser attachment of this invention provides an apparatus which can accommodate another denomination of coin, and which can be attached to an existing coin dispenser for dispensing the additional denomination into the same coin cup which receives coins automatically ejected from the coin dispenser.

SUMMARY OF THE INVENTION

In accordance with the invention there is provided an attachment for a coin dispenser which has an inclined discharge chute extending outwardly from a coin discharge point in a wall of the coin dispenser, the attachment including a funnel assembly adapted for mounting upon the discharge chute and having a funnel at one end and an inclined delivery chute leading from the funnel and extending to an exit point above the discharge chute at a distance remote from said discharge point, and a coin storage and ejector assembly adapted for mounting on the coin dispenser wall and including a coin magazine for receiving a stack of coins, and a manually actuated ejector mechanism for removing coins one at a time from the stack and moving the coins to the funnel.

The invention may further reside in such an attachment in which the stack of coins is normally supported on a coin rest which has a coin opening disposed over the top of the funnel, and the ejector mechanism removes the bottommost coin and moves it to the opening.

The invention may further reside in a coin dispenser attachment kit having component parts capable of being assembled to a coin dispenser to provide the added capacity to dispense an additional denomination of coin, and including such funnel assembly and such coin storage and ejector assembly.

The invention may also reside in such an attachment in which the funnel has a central upright deflector partition which defines two spaced apart channels which lead to the delivery chute, the partition changing the attitude of each coin from horizontal to vertical so that the coins can roll down the delivery chute to the exit and into the discharge chute.

It is a principal object of this invention to provide an attachment for a coin dispensing machine which permits the manual dispensing of an additional denomination of coin and in which the additional denomination is dispensed to the same delivery point as are coins mechanically ejected from the coin dispenser.

It is another object of the invention to provide such a coin dispensing attachment which permits delivery to a shallow cup which can be positioned at any point within a radius about an axis of rotation adjacent the mounting of the attachment to the coin dispenser.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 3 is a side view in elevation of the attachment affixed to the coin dispenser;

FIG. 6 is a view in horizontal section taken in the plane of the line 6—6 of FIG. 1 and showing alternative positions for the discharge chute extension.

DETAILED DESCRIPTION OF THE PREFERRED EMBODIMENT

Figure 1:
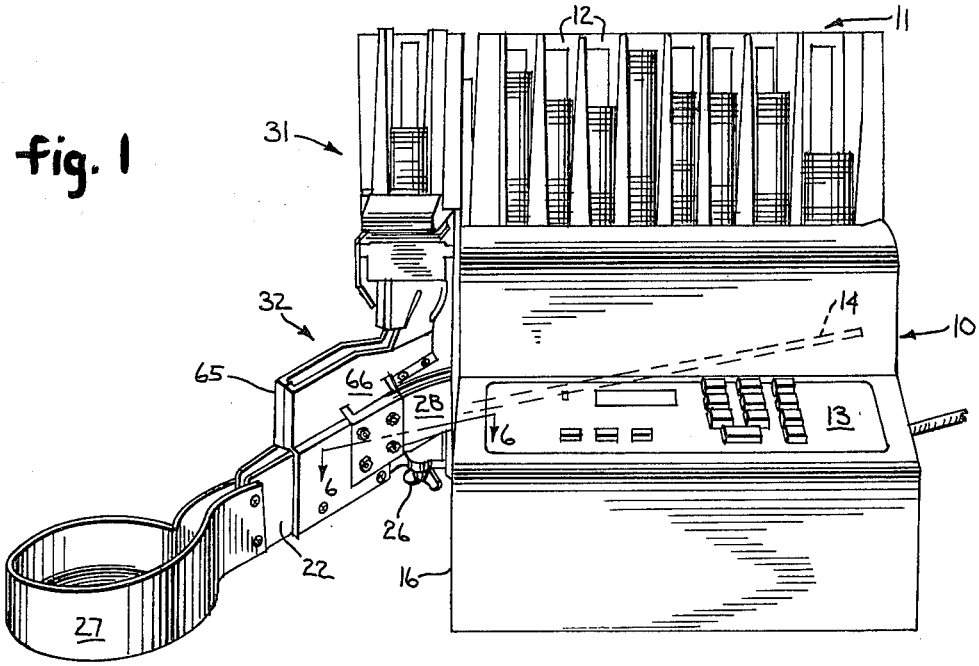
FIG. 1 is a view in perspective of a coin dispensing machine with the coin dispenser attachment of the present invention affixed thereto.

Referring to FIG. 1, a coin dispensing machine 10 will typically include a removable coin tray 11 which has a series of side-by-side compartments 12 each of which is adapted to hold a stack of coins of a particular denomination. Because of the mix of coins normally demanded, there is more than one compartment for certain denominations of coins, such as one-cent pieces. The coin dispenser 10 also includes a keyboard 13 which is used by the operator to input the information which results in the dispensing of coins. The coins held in the tray 11 are typically ejected from the bottom of the stack and fall into an inclined interior chute 14. Coins ejected from the bottom of the stacks in the tray 11 fall on edge onto the interior chute 14 and roll down the incline to a discharge point defined by an opening 15 in an end wall 16 of the coin dispensing machine 10.

At the point of discharge from the machine 10, the coins can be delivered by a variety of mechanisms, one of which employs a discharge chute extension leading to a shallow coin cup. Such a form of delivery system may also include a flexible connection to the interior chute so that the coin cup can be positioned as desired relative to the coin dispenser. This general type of coin delivery system is shown in U.S. Pat. No. 2,888,124 issued May 26, 1959 to A. R. Buchholz for "Coin Delivery Chute" and is the form of coin delivery system for which the present invention is particularly advantageously adapted.

Such a coin delivery system includes an apertured mounting plate 20 for attachment about the discharge opening 15 in dispenser 10. An angled bracket 21 provided with an axial opening and having a series of serrations on its top surface extends from the mounting plate 20. An exterior discharge chute section 22 is formed by rigid side plates 23 which are spaced apart and secured to a bottom member 24 which has a mounting end 25 having a hole adapted to be aligned with the hole in the bracket 21 and having a serrated underside. A threaded pivot pin is received in the aligned holes in the mounting end 25 and the bracket 21, and a wingnut 26 is threaded on the pivot pin. A shallow cup 27 is mounted on the outer end of the discharge chute section.

A flexible connection between the internal chute 14 and the external discharge chute section 22 is provided by a pair of spaced spring or resilient metal strips 28 which extend into the opening 15 in the coin dispenser on either side of the internal chute 14. As will be appreciated, the external discharge chute 22 and cup 27 can be adjusted in any position within a sweep of about 180 degrees relative to the discharge opening 15 of the coin dispenser about the pivot pin.

What has been described thus far represents the existing state of the art.

The apparatus of the present invention consists of two main assemblies: an upper storage and ejector assembly indicated generally by the numeral 31, and a lower funnel assembly indicated generally by the numeral 32. The upper assembly 31 includes a shim plate 33 which has a central opening 34 which is aligned with the opening 15 in the wall 16 and which is attached by screws 35 which extend through the shim plate 33 at positions both above and below the discharge opening 15. A lower support bracket 36 has an upwardly projecting central portion 37 and a pair of spaced apart flanges 38, one of which is connected to an upper lateral area of the shim plate 33. The central portion 37 of the lower support bracket 36 mounts the lower end of a coin rest 40 which has a forwardly projecting coin rest plate 41 and an upwardly projecting rearwardly inclined back 42. An upper support bracket 43 has a pair of parallel arms 44 joined by a bridge section 45. The bridge section 45 is mounted to the back 42 of the coin rest 40 by suitable fasteners, and the arm 44 of the upper support bracket adjacent the end wall 16 is secured to that end wall by means of a threaded fastener.

A coin magazine 46 is mounted upon the coin rest 40 and has its spine contoured to conform with the shape of the back 42 of the coin rest 40. The magazine 46 has a single elongated trough which is adapted to receive a stack of coins of one denomination. The bottommost coin in the stack will rest upon the plate portion 41 of the coin rest 40. The plate portion 41 of the coin rest has an enlarged circular coin opening 47 at a point outward of the bottom of the stack. Coins may be moved from the bottom of the stack in the magazine 46 along the top surface of the plate portion 41 of the coin rest and to the coin opening 47 by means of an ejector mechanism.

The ejector mechanism includes a coin ejector carrier 50 in the form of a plate having an opening 51 slightly larger than the diameter of the denomination of coin and a rearwardly extending tongue 52 which mounts a pivot bracket 53 having a pair of outwardly projecting ears 54 on opposite sides. The coin ejector carrier 50 slides over the coin rest plate 41 with the tongue extending through a slot in the lower support bracket 36. A compression spring 55 is held between the lower support bracket 36 and the pivot bracket 53 to urge the coin ejector carrier 50 to a rearward position where the coin opening 51 in the carrier is aligned with the bottom of the stack of coins in the magazine 46.

The coin ejector carrier is caused to move forward against the force of the compression spring 55 by a manually actuated lever having a pair of spaced bell crank lever arms 56 and a handle 57 spanning the arms. The bell crank lever arms 56 are pivoted intermediate their ends on pins 58 extending from spaced legs 59 of the lower support bracket 36. The free ends of the bell crank lever arms mount pivot pins 60 which are received in elongated slots intermediate the ends of respective ones of a pair of links 61. The links 61 are pivotally connected at their upper ends to the arms 44 of the upper support bracket 43 and the lower ends of the links are formed with slots which engage the ears 54 of the pivot bracket 53. The linkage mechanism and brackets are enclosed by a suitable housing.

Figure 4:
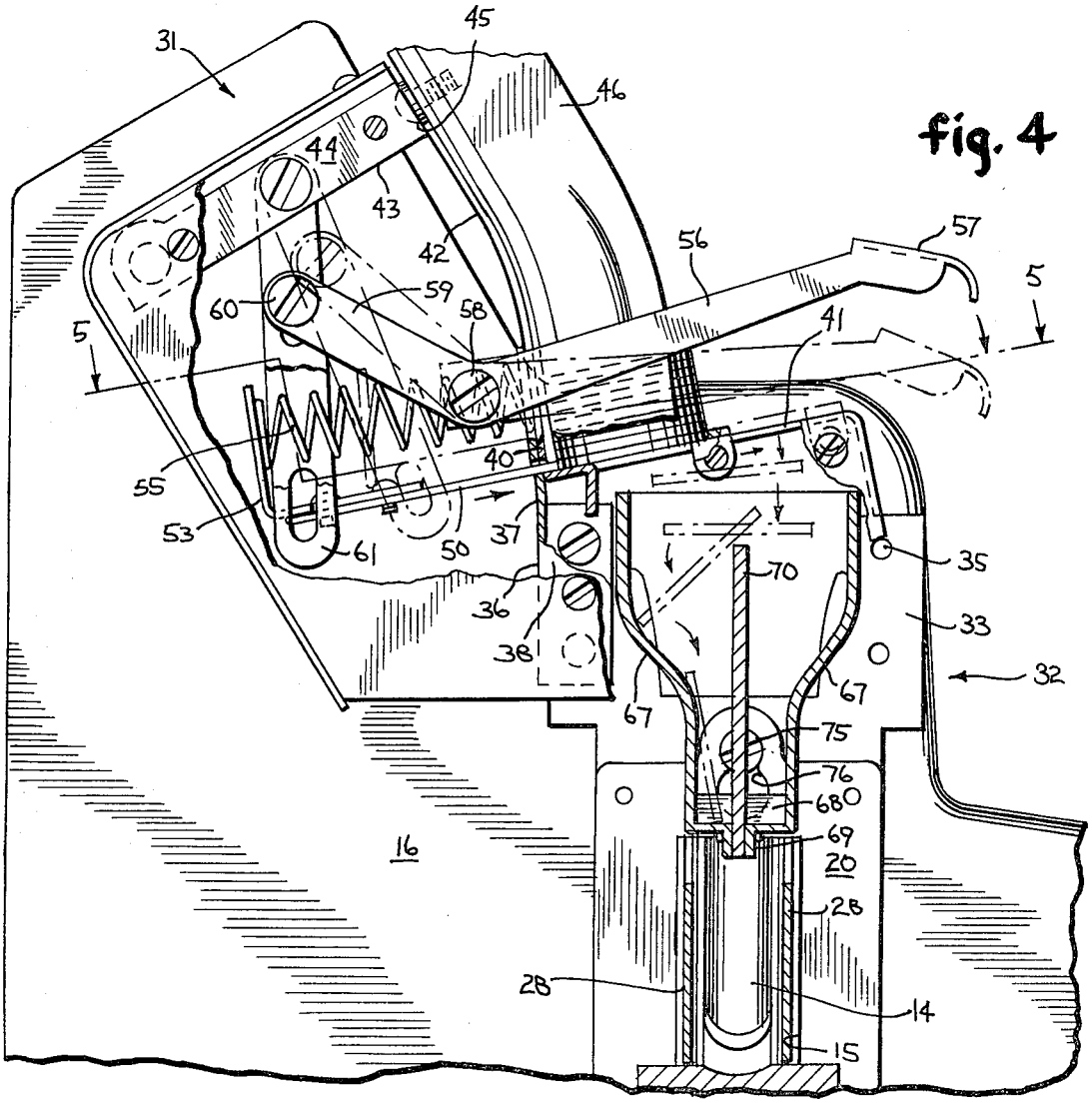
FIG. 4 is a view similar to FIG. 3 but to an enlarged scale and showing parts broken away and in cross section for purposes of illustration.
Figure 2:
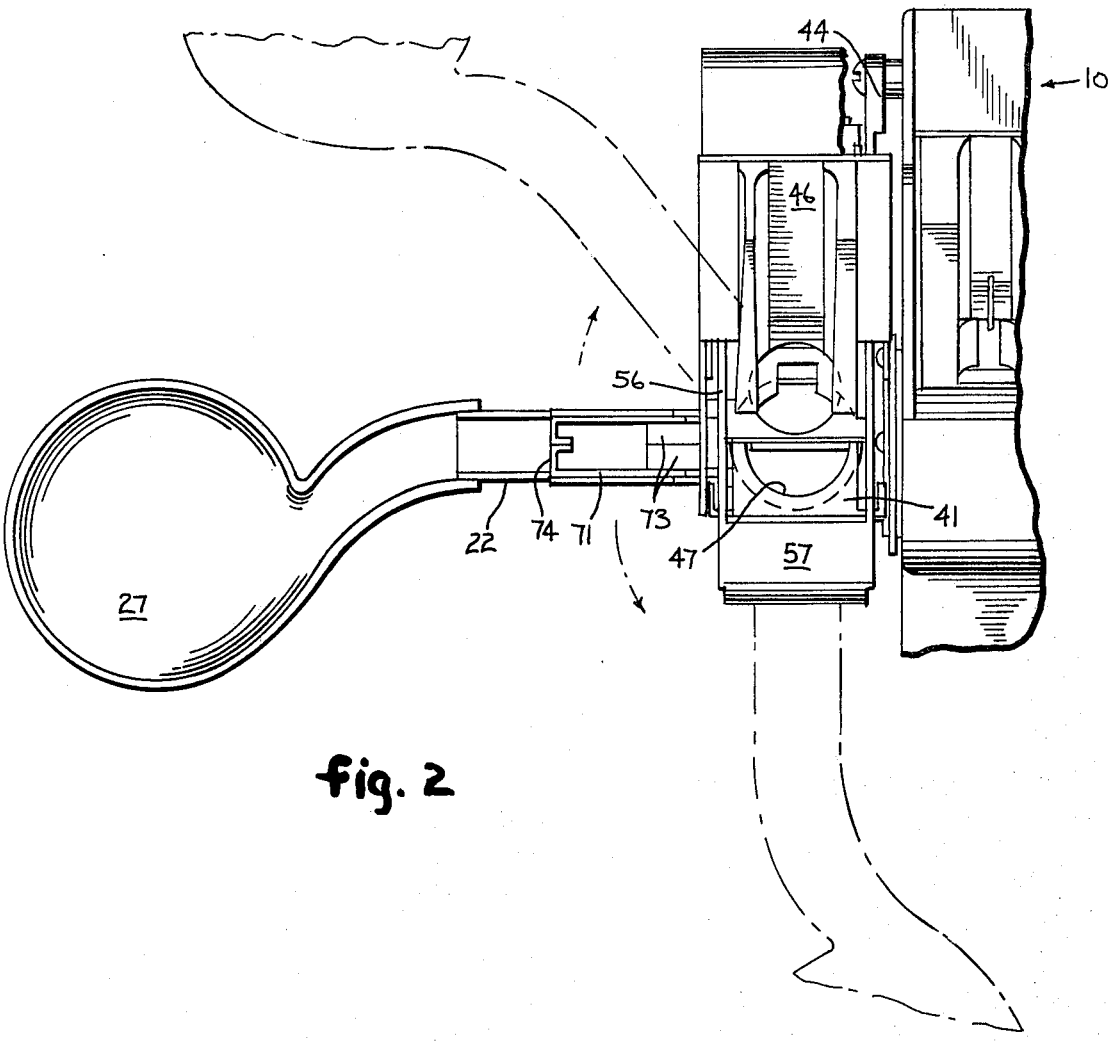
FIG. 2 is a top plan view of the coin dispenser attachment with portions broken away for clarity.
Figure 5:
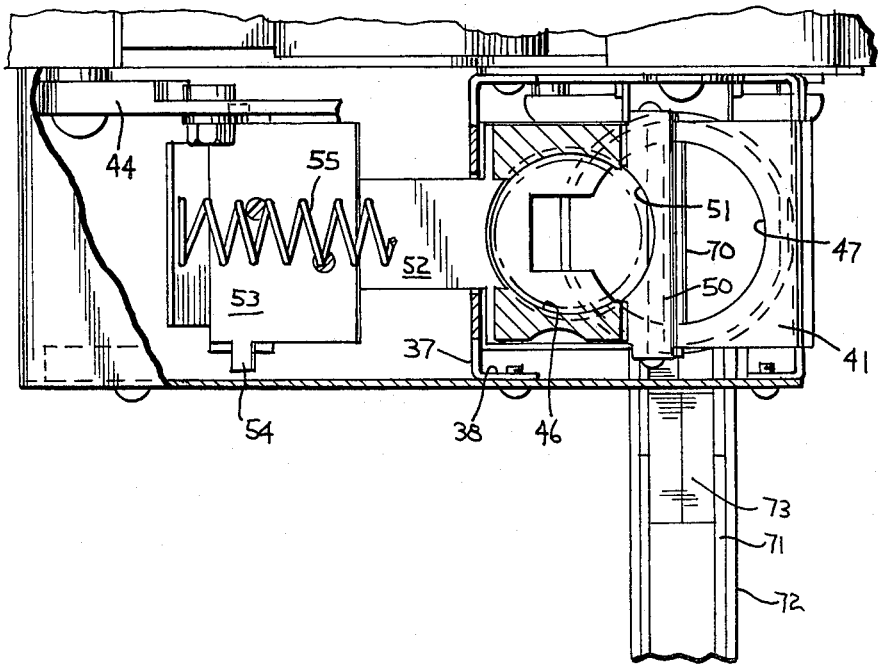
FIG. 5 is a top plan view taken in the plane of the line 5—5 of FIG. 4.

Under the urgings of the compression spring 55, the linkage mechanism for actuating the coin ejector will assume the position shown in solid lines in FIG. 4. Each time the handle 57 is manually depressed, the links 61 will be pivoted forward with the result that the ejector carrier 50 will move the bottommost coin from the stack over the surface of the coin rest plate 41 until the bottommost coin is free to fall through the coin opening 47 therein. The funnel assembly 32 acts to receive and suitably deliver the ejected coin to the cup 27.

Figure 7:
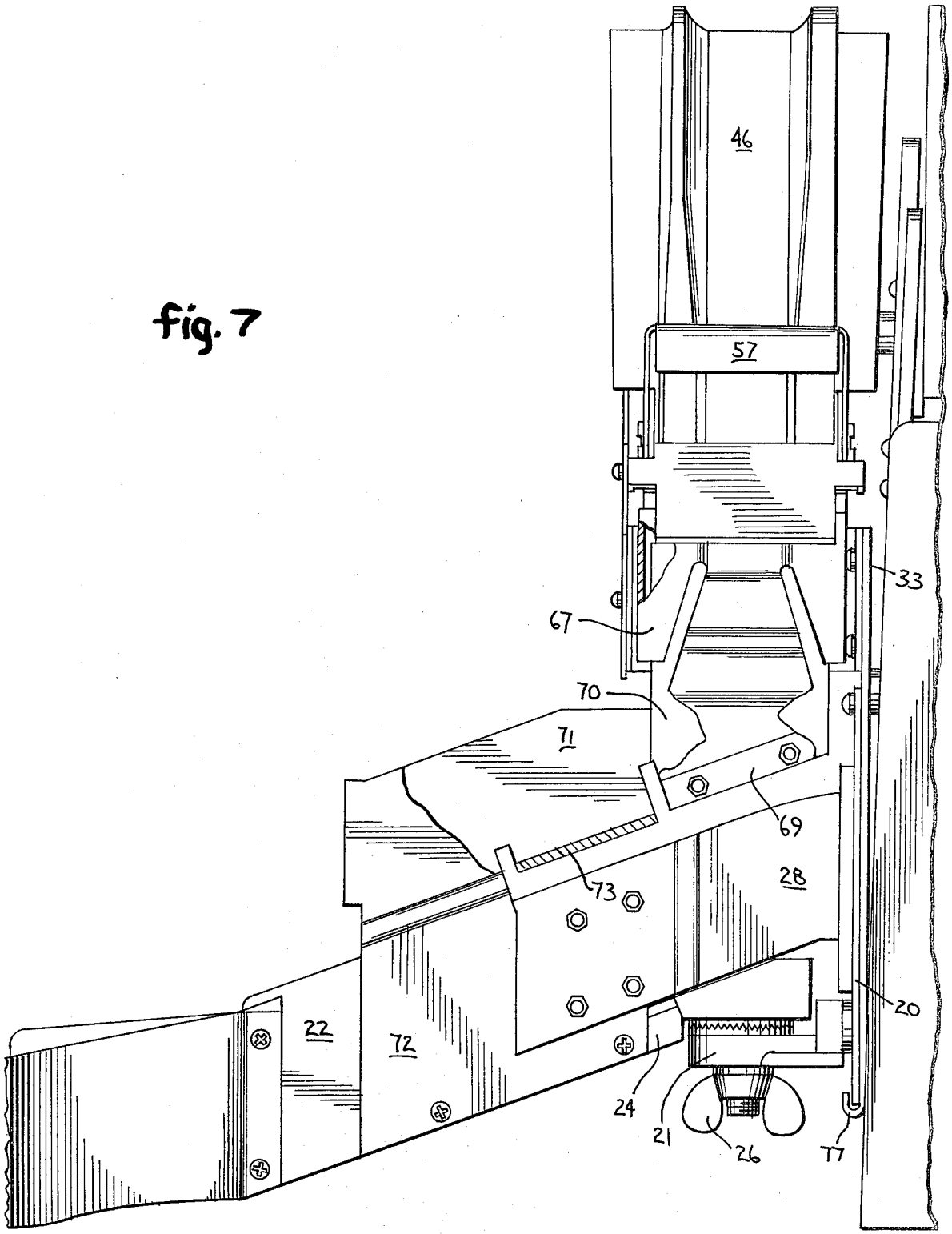
FIG. 7 is a view in front elevation, and partly in section, of the attachment.

The funnel assembly 32 is adapted to be mounted upon the existing external discharge chute section 22 and is otherwise free of attachment to the coin dispensing machine 10. As a result, the funnel assembly 32 can be moved and positioned as the discharge chute and cup 27 are moved and positioned. The funnel assembly 32 includes left- and right-hand coin funnel delivery members 65 and 66 which are formed from flat plates. Each delivery chute member 65 and 66 includes a funnel section 67 formed at one end with an open-ended, generally semi-circular, cylindrical top edge and an inwardly sloping side body (see FIGS. 4 and 7). The funnel sections 67 terminate at their bottom in a laterally extending floor portion 68 and a downwardly extending flange 69. The upper surface of the floor portion 68 is inclined. An upright deflector partition 70 is mounted at its lower end between the flanges 69 of the two members 65 and 66, and the partition projects upwardly between the funnel sections 67.

As seen in FIG. 4, the center line of the funnel formed by the joined funnel sections 67 is adapted to be positioned at the axis of rotation of the discharge chute 22 about the mounting plate 20, and with the open top of the funnel beneath the coin opening 47 in the coin rest plate 41. Coins which are ejected from the magazine 46 and fall through the coin opening 47 will strike the upper edge of the deflector partition 70 and will be tripped so that their attitude will change from a generally horizontal to a generally vertical position. The coins will fall through the funnel until their edge contacts the inclined floor portion 68 on a side of the deflector partition 70.

The chute members 65 and 66 also each include a delivery chute side portion 71 extending from the funnel section 67 and connected at its other end to a downwardly extending mounting section 72. The mounting sections 72 of the two members 65 and 66 are adapted to be fastened to the side plates 23 of the discharge chute section 22. The spaced side portions 71 of the two members 65 and 66 extend parallel to and above the side plates 23 of the discharge chute 22. An inclined ramp is formed by inwardly projecting ramp portions 73 which extend from the bottom edge of the side portion 71 intermediate its length. The entrance to the ramp portions is at a level slightly below the level of the floor portions 68 of the funnel sections 67. At its outer extremity, each side portion 71 terminates in a U-shaped end wall 74 which is joined to the like end wall of the other member.

Coins ejected into the funnel will first roll on edge along a floor portion 68 at the base of the funnel and will then drop down and roll on edge along the ramp portions 73 between the side portions 71 until they reach the exit point of the ramp portions 73. At that time, the coins are free to fall into the open top of the discharge chute section 22 and to continue through that chute section to the cup 27. At the same time, coins which are ejected internally of the dispenser machine 10 will roll out the discharge chute section 22 into the cup 27. By directing coins on edge along an incline for some distance before they are deposited into the discharge chute section 22, the manually ejected coins will not interfere with the coins being internally ejected from the dispensing machine 10. Depositing the manually ejected coins directly into the discharge chute 22 near the discharge opening 15 could cause a jam of coins at that point.

The attachment of the present invention can be used for field modification of existing coin dispensing machines having a discharge chute section. As such, the attachment can be supplied as a kit of parts whose components would consist of the upper storage and ejector assembly 31 and the lower funnel assembly 32. In assembling the kit to the coin dispensing machine 10, the discharge chute section 22, with the mounting plate 20 and cup 27, are first removed from their attachment about the discharge opening 15. The shim plate 33 would then be attached to the side wall 16 of the dispensing machine and the one arm from the upper bracket would be fastened to the end wall 16. This will mount the upper storage assembly 31 to the machine 10. The lower funnel assembly 32 would then be attached to the discharge chute section 22 by having its mounting sections 72 fastened thereto by screws. The assembled funnel assembly 32 and discharge chute section 22 together with the cup 27 and mounting plate 20 would then be reattached to the dispensing machine 10 to complete the installation. This is accomplished by hanging the mounting plate 20 on the shim plate 33 with a headed fastener 75 being received within a keyhole slot 76 which is a standard feature of the mounting plate 20. The lower edge of the mounting plate 20 would rest in an upturned lip 77 formed along the bottom edge of the shim plate.

In the foregoing manner the coin dispensing machine can be easily adapted to dispense an additional denomination of coin and to deliver that denomination to the same delivery point as for coins dispensed internally. The operator of the coin dispenser can then input information into the keyboard to dispense certain combinations of change. While the mechanical dispensing is being accomplished, the operator can manually actuate the handle 57 once for each coin desired from the coin magazine 46 and all coins will be delivered to the cup 27. The only attachment of the funnel assembly 32 is to the discharge chute section 22 so that it is free to be positioned along with the cup 27.

Although the storage and ejector assembly 31 is shown mounted on the left side of the coin dispensing machine 10, it is symmetrical in construction so that it can as easily be mounted on the right side. Since the funnel assembly 32 is symmetrical about its center line, it can also accommodate either right- or left-hand mounting of the discharge chute section 22.

I claim:

1. An attachment kit having component parts capable of being assembled to a coin dispenser which includes an inclined discharge chute extending outwardly from a coin discharge point in a wall of the coin dispenser, said attachment kit comprising:

a funnel assembly adapted for mounting upon the discharge chute and including a funnel at one end and an inclined delivery chute leading from the funnel and extending to an exit point above the discharge chute at a distance remote from said discharge point; and a separate coin storage and ejector assembly adapted for mounting on said wall of the coin dispenser without physical connection to said funnel assembly, said storage and ejector assembly including a coin magazine for receiving a stack of coins of a particular denomination, and a manually actuated ejector mechanism for removing coins one at a time from the stack and moving the coins to said funnel.

2. An attachment kit having component parts capable of being connected to a coin dispenser which includes an inclined discharge chute extending outwardly from a coin discharge point in a wall of the coin dispenser, said attachment kit comprising:

a funnel assembly adapted for mounting upon the discharge chute and including a funnel at one end and an inclined delivery chute leading from the funnel and extending to an exit point above the discharge chute at a distance remote from said discharge point; and a coin storage and ejector assembly adapted for mounting on said wall of the coin dispenser and including a coin magazine for receiving a stack of coins of a particular denomination, and a manually actuated ejector mechanism for removing coins one at a time from the stack and moving the coins to said funnel;

said funnel assembly comprising:

left- and right-hand members each having a funnel portion at one end forming one-half of said funnel, an intermediate delivery chute side portion, and a mounting portion at the other end, an upright deflector partition disposed between said funnel portions and defining therewith two spaced inclined channels at the base of the funnel, and inclined ramp portions extending from said side portions and together defining a ramp to receive coins on edge which roll off said inclined channels, said mounting portions each being adapted to be secured to a respective side of said discharge chute with said funnel and delivery chute being disposed above the length of the discharge chute.

3. The combination with a coin dispenser which includes an inclined discharge chute extending outwardly from a coin discharge point in a wall of the coin dispenser, of an attachment comprising:

a funnel assembly mounted upon the discharge chute and including a funnel portion at one end and an inclined delivery chute portion leading from the funnel portion and extending to an exit point above the discharge chute at a distance remote from said discharge point; and a separate coin storage and ejector assembly mounted on said wall of the coin dispenser physically unconnected with said funnel assembly and including a coin magazine for receiving a generally upright stack of coins of a particular denomination, a coin rest normally supporting the bottom coin in the stack, said coin rest having a coin opening which can be disposed over the open top of said funnel, and a manually actuated ejector mechanism for removing coins one at a time from the bottom of said stack and moving the coin to said coin opening.

4. An attachment kit having component parts capable of being assembled to a coin dispenser which includes an inclined discharge chute extending outwardly from a coin discharge point in a wall of the coin dispenser, said attachment kit comprising:

a funnel assembly adapted for mounting upon the discharge chute and including a funnel portion at one end and an inclined delivery chute portion leading from the funnel portion and extending to an exit point above the discharge chute at a distance remote from said discharge point, said funnel portion including a centrally located upright deflector partition which changes the attitude of coins from horizontal to vertical as the coins fall into the funnel portion; and a coin storage and ejector assembly adapted for mounting on said wall of the coin dispenser and including a coin magazine for receiving a generally upright stack of coins of a particular denomination, a coin rest normally supporting the bottom coin in the stack, said coin rest having a coin opening which can be disposed over the open top of said funnel, and a manually actuated ejector mechanism for removing coins one at a time from the bottom of said stack and moving the coin to said coin opening.

5. An attachment kit in accordance with claim 4 wherein said ejector mechanism comprises:

a flat coin carrier adapted to slide over said coin rest and having a generally circular opening;

a spring urging the coin carrier to a position in which the bottommost coin of the stack is received in said opening in said carrier;

a handle pivoted in said storage and ejector assembly; and a linkage joining the handle to the carrier to move said carrier forward against the urging of said spring whenever the handle is depressed.

6. A coin dispenser attachment kit having component parts capable of being assembled to a coin dispensing machine for adding the capacity to dispense an additional denomination of coin, which coin dispensing machine includes an inclined discharge chute extending outwardly from a coin discharge point in a wall of the machine, the kit comprising:

a funnel assembly adapted to be mounted upon the discharge chute and including a funnel at one end and an inclined delivery chute leading from the funnel and extending to an exit point above the discharge chute at a distance remote from said discharge point; and a separate coin storage and ejector assembly adapted to be mounted on said wall of the coin dispensing machine without connection to said funnel assembly, said storage and ejector assembly including a coin magazine for receiving a generally upright stack of coins of a particular denomination, a coin rest normally supporting the bottom coin in the stack, said coin rest having a coin opening adapted to be disposed over the open top of said funnel, and a manually actuated ejector mechanism for removing coins one at a time from the bottom of said stack and moving the coin to said coin opening.

* * * * *